United States Patent [19]

Cotroneo

[11] 4,234,909

[45] Nov. 18, 1980

[54] ILLUMINATED DOOR LOCK

[76] Inventor: Peter R. Cotroneo, 63 Smithtown Polk Blvd., Centereach, N.Y. 11720

[21] Appl. No.: 915,894

[22] Filed: Jun. 15, 1978

[51] Int. Cl.[3] ..... E05B 17/10

[52] U.S. Cl. ..... 362/100; 362/95; 362/29

[58] Field of Search ..... 362/29, 95, 100

[56] References Cited

U.S. PATENT DOCUMENTS

| | | | |
|---|---|---|---|
| 2,309,840 | 2/1943 | Garvert et al. | 362/100 |
| 2,449,150 | 9/1948 | Schnoll | 362/95 |
| 2,575,820 | 11/1951 | Linton | 362/95 |
| 2,709,745 | 5/1955 | Sundt | 362/100 |
| 3,268,659 | 8/1966 | Gibson, Jr. | 362/29 X |
| 4,038,582 | 7/1977 | Horwinski | 362/95 |

*Primary Examiner*—Harold J. Tudor

[57] ABSTRACT

An illuminated door lock is described which comprises in combination a door, a lock fitting in a hole through said door, a plate of translucent material resting on the exterior of the door, said plate having a hole in the middle which is coaxial with the hole in the door through which the lock fits, means for securing said plate around the lock, at least one recess in the plate for accommodating at least one light bulb, said plate having a thickness of at least ¼ inch and being at least ½ inch wide, said bulb having a length between ¼ inch and ⅜ inch; means for establishing contact between said bulb and a source of electric energy.

2 Claims, 10 Drawing Figures

ILLUMINATED DOOR LOCK

This invention relates to an illuminated door lock, more specifically to an illuminated door lock which may be used in cars as well as in homes, offices and other building establishments.

There has been a need of devices for lighting the keyhole of doors, not only in cars but in the case of private homes and other building establishments, mainly because it is difficult to find the key-lock if the street is not adequately lit particulary for older people whose eyesight is far from perfect. Many devices have been proposed for illuminating the keyhole of doors of cars, homes, etc. Most of these devices, however, are fairly complicated and require additional manufacturing steps. In the device of U.S. Pat. No. 3,478,199 the lock includes the conventional push button for opening the door of a car, the push button being arranged to actuate a switch for actuating the light. The device comprises an externally threaded tube which extends through the door, the tube having an inner end which faces the bulb and being aligned with the bulb so that the light from the bulb shines into the tube. The device is additionally provided with a lens made of translucent material secured to the tube at the outer end. This device requires additional steps during the manufacture of a conventional car door, namely three holes should be drilled in the door or in the latching mechanism. One of the holes is needed to mount the arm, that is the actuating member and to accommodate the bolt which is needed to fix the actuating member. A second hole is needed to receive the tubular member and the third hole must be drilled in the door on the inside portion to permit replacement of the bulb. It should be noted that the light in the door lock of this patent only goes on when it is actuated by the push button and the device is essentially suitable only for car doors.

In the device of U.S. Pat. No. 2,709,745 a first magnetic core is secured in the door opening of the stationary part of the door structure, which magnetic core is connected to a source of alternating voltage such as the conventional household bell transformer. The device comprises a second magnetic core which is carried by the door adjacent to and in alignment with the first core when the door is closed. A lamp is carried by the stationary part of the door structure and is connected in series with the winding on the first core for illuminating the door opening when the door is opened. When the door is closed, the impedance of the winding is high and the lamp is off but when the door is opened, the impedance of the winding is decreased and the lamp is lighted.

The object of the present invention is to provide an illuminated door lock which is suitable for cars as well as building establishments and private homes and which is illuminated at all times.

Another object of the present invention is to provide an illuminated door lock which may be easily manufactured and assembled without requiring additional equipment and substantial additional steps in the assembly line of cars or in the manufacture of doors for a variety of building establishments.

Still another object of the present invention is to provide a door lock which is illuminated by a small amount of light and which requires no substantial amount of electric energy and which could even be operated by a battery.

The crux of the present invention resides in the finding that it is possible to apply a plate of translucent material on the exterior surface of the door around the door lock and insert at least one small bulb of the size of $\frac{1}{8}$ inch–$\frac{3}{8}$ inch in length, in the plate and keep the bulb lit at all times. The amount of light which diffuses from the bulbs is sufficient to illuminate the door lock even if the bulb is not exactly along the path of the door lock itself. In view of the fact that the translucent material is placed externally around the lock, it is clear that no additional drilling steps are required and the device of the present invention may be used with any conventional door lock used in automobiles and in other building establishments.

The invention is further illustrated by the drawings of which:

By reference to the figures, numeral 1 designates a door, for instance a car door and numeral 2 designates a conventional door lock. Numeral 3 designates a handle. Numeral 4 designates the plate of plastic material which is externally placed around the lock. The material must be translucent but may also be transparent. This plastic plate is held in place around the door lock by the door lock itself but in order to make sure that the plate does not move and that the plate is held firmly in place, several means may be used such as for instance a metal rim 7, one edge of which fits into the hole. Numeral 10 designates the rear portion of the rim 7. The plastic plate is at least $\frac{1}{2}$ inch wide. The thickness of the plate ranges between $\frac{1}{4}$ inch and about $\frac{3}{8}$ inch. Numeral 8 is the conventional clip of U shape used to hold the lock in the door opening.

Figure 1:
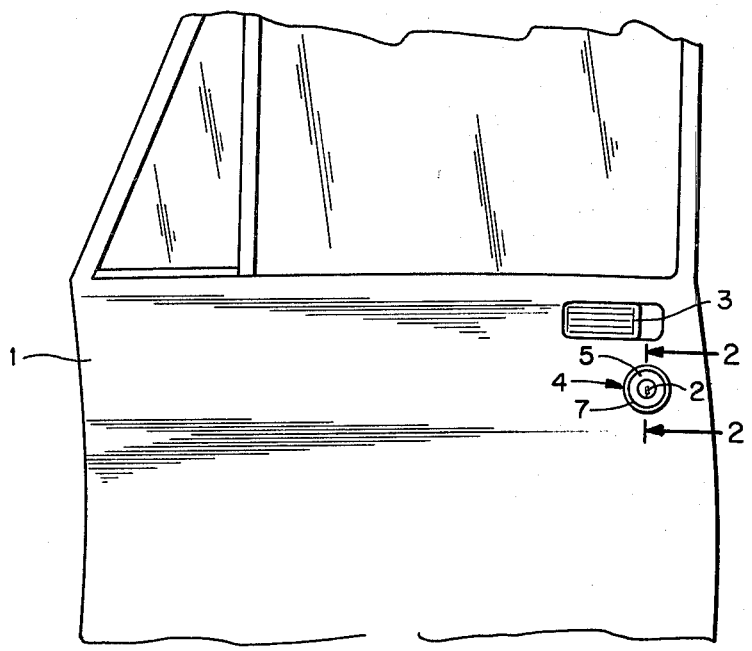
FIG. 1 is a front elevations view of the door lock which may be, for instance, the door lock of an automobile door incorporating the present invention.
Figure 2:
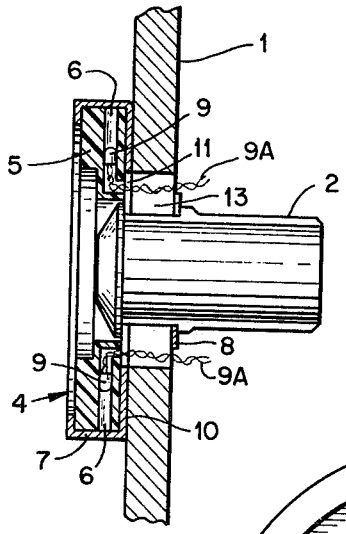
FIG. 2 is a cross sectional view of the device of FIG. 1 along the line 2—2 of FIG. 1 in the direction of arrows.
Figure 3:
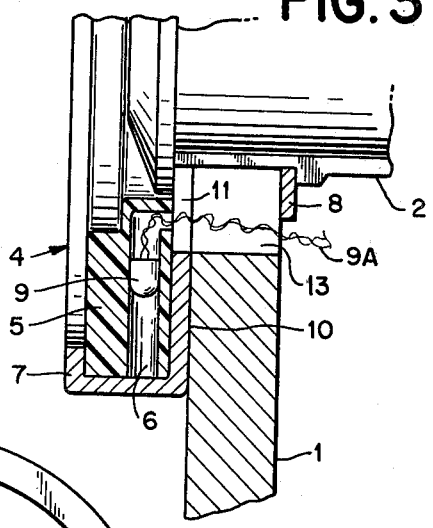
FIG. 3 is an enlarged partial cross-section of the device of FIG. 2 showing the device more clearly and specifically the passage of the wires.
Figure 3A:
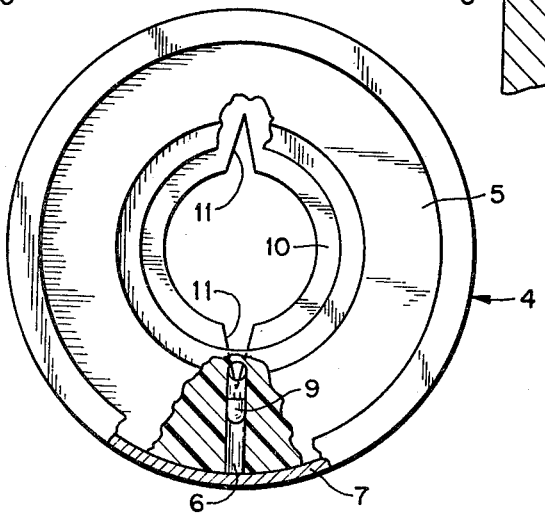
FIG. 3A is an enlarged view of the illuminated member of the device showing notches for passage of bulb wires and exposing one of the two bulb locations.

As shown in FIGS. 3 and 3A, at least one recess 6 is made through the plate to accommodate at least one bulb 9. This recess is hardly visible from the exterior and does not affect the appearance of the door. Sufficient space must be provided from the recess for the electric wires 9A to go through and make adequate contact with a source of electrical energy.

Figure 4:
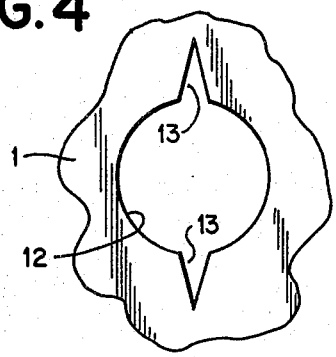
FIG. 4 is a partial view of a conventional door lock hole with two notches added for passage of bulb wires.

FIG. 3A and FIG. 4 show the usual opening 12 which is drilled through a car door for insertion of the lock. This opening as shown is provided with two notches 13 which are needed for passage of the electric wires 9A.

Figure 5:
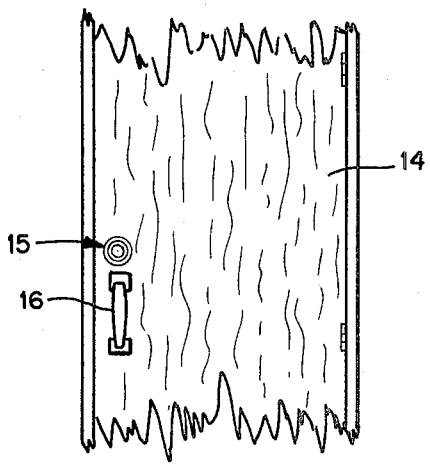
FIG. 5 is a partial view of a conventional house door with illuminated device affixed hereto.
Figure 6:
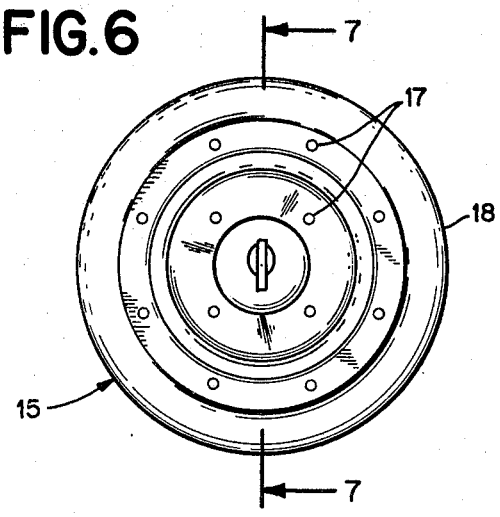
FIG. 6 illustrates an embodiment of the invention suitable as a house lock.

FIG. 5 shows a modification of the present invention which is particularly suitable for the lock of a house door. Numeral 14 is the door, numeral 15 is the illuminated door lock and numeral 16 is the handle. Essentially the same plate made of translucent material is used, as shown by numeral 19, but in view of the fact that frequently this type of lock has an external metallic cover 18 which surrounds the lock, it is necessary to drill a few holes, shown by numeral 17, in order to let the light go through.

Figure 7:
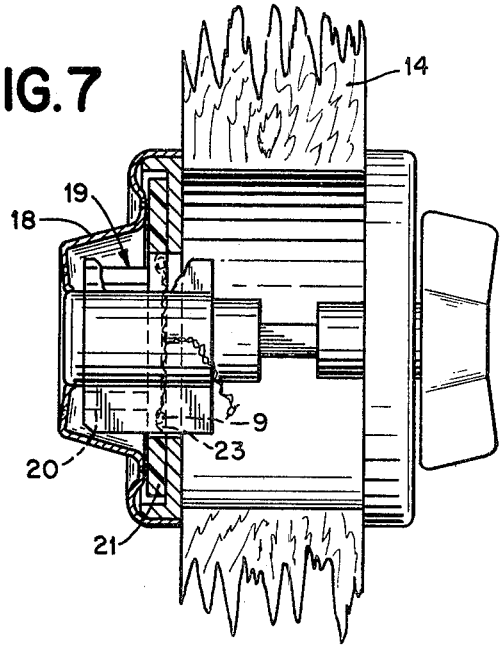
FIG. 7 is a cross sectional view of the device of FIG. 6 along line 7—7 of FIG. 6.
Figure 8:
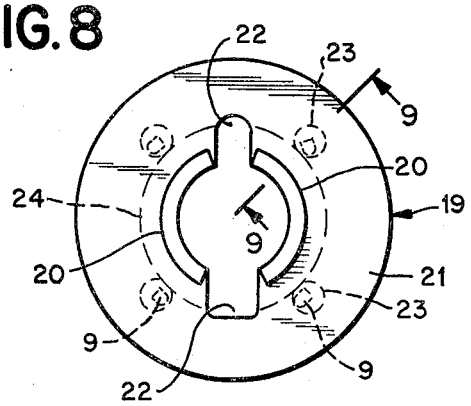
Figure 9:
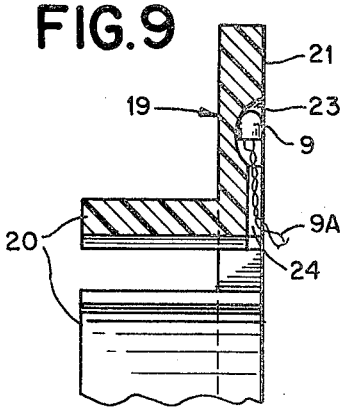

In FIGS. 7, 8 and 9, numeral 20 designates the sections of a cylinder used to prevent motion of the lock. Numeral 21 is the rear portion of cylinder section 20 and numeral 22 designates the recesses used to insert the lock. The recess for the bulb is designated by numeral 23 and numeral 24 designates the recess for the passage of the electric wires.

I claim:

1. An illuminated door lock which comprises in combination with a door, a lock which fits into an aperature in said door, a metal plate holding a translucent material, both the plate and translucent material having a central circular aperture the diameter of the aperture plate being smaller than the diameter of aperture of the translucent material, a lock cylinder having a cylindrical body portion and a face portion, said face portion having a larger diameter than the body portion, said aperture in the metal plate will let only said cylindrical body portion through, said face portion being positioned inside said aperature of the translucent material and in contact with said plate, said face portion in contact with said plate holding the metal plate in contact with the door by a "U" shaped tenstion clip placed inside the door, the translucent material being held in place by the metal plate having a metal rim which forms a complete frame around the translucent material, at least one recess in the translucent material for accommodating at least one light bulb, both the door and the metal plate have at least one notch which extends outwardly from the aperature in the door and metal plate for accomodate electrical wires connecting a power source to the at least one light bulb and at least one additional notch in the door and the metal plate which accomodates a raised rib on said cylindrical body portion to prevent turning in the aperature.

2. The illuminated door lock according to claim 1 wherein two bulbs are used.

* * * * *